US008137161B2

(12) United States Patent
Haneda et al.

(10) Patent No.: US 8,137,161 B2
(45) Date of Patent: Mar. 20, 2012

(54) DISK-SHAPED SUBSTRATE MANUFACTURING METHOD

(75) Inventors: Kazuyuki Haneda, Ichihara (JP); Satoshi Fujinami, Minamitsuru-gun (JP); Takeshi Jonouchi, Minamitsuru-gun (JP)

(73) Assignees: Showa Denko K.K., Tokyo (JP); Citizen Seimitsu Co., Ltd., Yamanashi (JP)

( * ) Notice: Subject to any disclaimer, the term of this patent is extended or adjusted under 35 U.S.C. 154(b) by 1031 days.

(21) Appl. No.: 12/054,078

(22) Filed: Mar. 24, 2008

(65) Prior Publication Data

US 2008/0233841 A1 Sep. 25, 2008

(30) Foreign Application Priority Data

Mar. 23, 2007 (JP) ..... 2007-077434

(51) Int. Cl.
*B24B 55/06* (2006.01)

(52) U.S. Cl. ..... 451/54; 451/453

(58) Field of Classification Search ..... 451/54, 451/87, 88, 453, 456
See application file for complete search history.

(56) References Cited

U.S. PATENT DOCUMENTS

| | | | | |
|---|---|---|---|---|
| 2,484,277 | A * | 10/1949 | Fisher | 96/262 |
| 2,912,918 | A * | 11/1959 | Mead | 454/66 |
| 3,657,991 | A * | 4/1972 | Oberg | 454/49 |
| 3,672,292 | A * | 6/1972 | Arnold | 454/49 |
| 4,667,580 | A * | 5/1987 | Wetzel | 454/187 |
| 5,653,623 | A | 8/1997 | Kimura et al. | |
| 5,655,954 | A | 8/1997 | Oishi et al. | |
| 2003/0164181 | A1 | 9/2003 | Ohtani | |

FOREIGN PATENT DOCUMENTS

| | | | |
|---|---|---|---|
| JP | 58-127033 | A | 7/1983 |
| JP | 62-069044 | A | 3/1987 |
| JP | 02-93633 | U | 7/1990 |
| JP | 02-198609 | A | 8/1990 |
| JP | 04-039552 | A | 2/1992 |
| JP | 07-223142 | A | 8/1995 |
| JP | 08-153697 | A | 6/1996 |
| JP | 09-288820 | A | 11/1997 |
| JP | 10-303168 | A | 11/1998 |
| JP | 2000-126532 | A | 5/2000 |
| JP | 2001-250226 | A | 9/2001 |
| JP | 2003-257945 | A | 9/2003 |
| JP | 2003-264165 | A | 9/2003 |

* cited by examiner

*Primary Examiner* — Robert Rose
(74) *Attorney, Agent, or Firm* — Sughrue Mion, PLLC

(57) ABSTRACT

The disk-shaped substrate manufacturing method is provided with: generating an air stream downward from an upper area during grinding a disk-shaped substrate in a grinding apparatus; arranging the grinding apparatus on an upper floor face of a floor and arranging water on a lower floor face of the floor, the upper floor face being made of a board having penetration holes or a mesh member, and the lower floor face supporting the upper floor face so as to be located above the lower floor face with a distance; and guiding dust made by the grinding apparatus to the water by use of the air stream.

8 Claims, 4 Drawing Sheets

FIRST LAPPING PROCESS

INNER AND OUTER CIRCUMFERENCE GRINDING PROCESS

FIRST LAPPING PROCESS

INNER AND OUTER CIRCUMFERENCE GRINDING PROCESS

OUTER CIRCUMFERENCE POLISHING PROCESS

SECOND LAPPING PROCESS

INNER CIRCUMFERENCE POLISHING PROCESS

FIRST POLISHING PROCESS

SECOND POLISHING PROCESS

FINAL WASHING AND INSPECTION PROCESS

DISK-SHAPED SUBSTRATE MANUFACTURING METHOD

CROSS REFERENCE TO RELATED APPLICATIONS

This application is based on and claims priority under 35 USC §119 from Japanese Patent Application No. 2007-77434 filed Mar. 23, 2007.

BACKGROUND OF THE INVENTION

1. Field of the Invention

The present invention relates to a disk-shaped substrate manufacturing method. As the disk-shaped substrate, a glass substrate for magnetic recording medium is exemplified.

2. Description of the Related Art

In recent years, the manufacture of disk substrates as disk-shaped substrates has become activated, under increased demands as recording media. As a magnetic disk substrate that is one of the disk substrates, an aluminum substrate and a glass substrate are used widely. The aluminum substrate is characterized by its high processability and low cost, meanwhile the glass substrate is characterized by its excellent strength, surface smoothness and flatness. In particular, requirements for compact size and high density of disk substrates recently have become extremely high, and the glass substrate of which surface roughness is small and that enables high density has attracted a lot of attention.

In the manufacture of such a magnetic disk substrate, it is important to enhance smoothness and flatness of the substrate by optimizing grinding and polishing conditions in grinding and polishing processes. In the recent years, the environment in the manufacturing process has been considered as an important factor as well as optimization of the grinding and polishing conditions. Among related arts described in official gazettes, there is an art of performing the final polishing on a substrate in a clean room while washing the substrate with a washing liquid. This method is employed in order to avoid a quality problem which might be caused if dust in the atmosphere attaches to the surface of the substrate after the final polishing of the substrate (for example, see Patent Document 1).

There is a different art described in an official gazette of performing a grinding process in the atmosphere, and performing a polishing process and the following processes in a clean room (dust-free room) with an attempt to prevent particles floating in the air from attaching to the substrate in the polishing process (for example, see Patent Document 2).

[Patent Document 1]

Japanese Patent Application Laid Open Publication No. 9-288820

[Patent Document 2]

Japanese Patent Application Laid Open Publication No.

Heretofore, there has been a challenge to prevent attachment of particles floating in the atmosphere to a substrate. In related arts, such a challenge is achieved by conducting processes, in which attachment of particles may be problematic, in a clean room. However, if all the processes in which attachment of particles is problematic are carried out in a clean room, the construction of a clean room as well as operation and maintenance of the facility requires an enormous amount of cost. Thus, the initial cost (initial investment cost) is increased, and thereby the manufacturing cost is increased. Especially, manufacturing of the magnetic disk substrate, which employs a cutting-edge technology, has a high rate of product turnover; thus, the cost spent on manufacturing facilities is an extremely influential factor in the product.

In the meantime, there is a variation in how particles should be removed among the manufacturing processes in the manufacturing of the magnetic disk substrate. For example, in the grinding process and the early polishing process, there is almost no adverse effect on the final product even if a relatively simple particle removal operation is performed. In contrast, if no step is taken at all for removal of particles, for example, particles floating in the atmosphere may attach to the surface of a magnetic disk substrate, and, for example, particles come to be mixed in a polishing liquid, thereby degrading the smoothness of the surface of the substrate. For these reasons, it has been strongly desired that particles are removed efficiently in a simple facility, without having to make a large facility investment such as a clean room.

The present invention has an object to establish a favorable environment for removing dust with a low facility cost and to manufacture a high-precision disk-shaped substrate in such a favorable dust removal environment.

SUMMARY OF THE INVENTION

The above object of an illustrative, non-limiting embodiment of the present invention may be achieved by a disk-shaped substrate manufacturing method provided with: generating an air stream downward from an upper area during grinding a disk-shaped substrate in a grinding apparatus and/or polishing a disk-shaped substrate in a polishing apparatus; arranging the grinding apparatus and/or the polishing apparatus on an upper floor face of a floor and arranging water on a lower floor face of the floor, the upper floor face being made of a board having penetration holes or a mesh member, and the lower floor face supporting the upper floor face so as to be located above the lower floor face with a distance; and guiding dust made by the grinding apparatus and/or the polishing apparatus to the water by use of the air stream.

In one aspect of the disk-shaped substrate manufacturing method of the present invention, the upper floor face is a lath board made of a metal board having a series of penetration holes. Therefore, this configuration may achieve good workability at the manufacturing site as well as produce an effect that an air stream is guided to the lower floor.

In another aspect of the disk-shaped substrate manufacturing method of the present invention, the water on the lower floor face forms a flow below the upper floor face. Therefore, the water which includes particles may be discharged along with the flow from the dust removal environment.

In further aspect of the disk-shaped substrate manufacturing method of the present invention, piping or wiring for grinding and/or polishing projects outward from a chassis of the grinding apparatus and/or the polishing apparatus in an area below a processing area of the grinding apparatus and/or the polishing apparatus. Therefore, the processing may be less affected when dust accumulated on the at least one of the piping and the wiring falls on the processing area, than in the case where the present configuration is not employed.

In furthermore aspect of the disk-shaped substrate manufacturing method of the present invention, the upper floor face also spreads in a working area for an operator handling the grinding apparatus and/or the polishing apparatus, and an air stream is generated in the working area so as to guide dust to the water, while the grinding apparatus and/or the polishing apparatus is exposed to the air stream. Therefore, a preferable dust removal environment including a working area as well as an apparatus area may be provided at a low cost.

BRIEF DESCRIPTION OF THE DRAWINGS

Exemplary embodiment(s) of the present invention will be described in detail based on the following figures, wherein.

DETAILED DESCRIPTION OF THE EMBODIMENTS

Hereinafter, exemplary embodiments of the present invention will be described in detail with reference to the attached drawings.

FIG. 1A to FIG. 1H are diagrams illustrating respective manufacturing processes of a disk-shaped substrate (a disk substrate) to which the exemplary embodiments are applied.

Figure 1A:
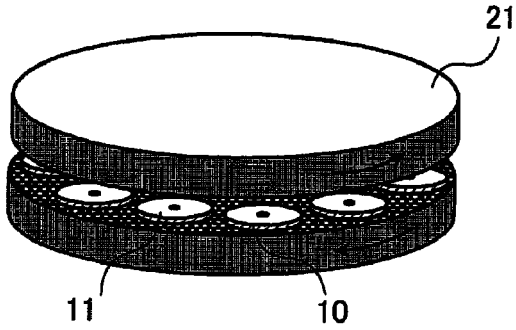
FIG. 1A to FIG. 1H are diagrams illustrating respective manufacturing processes of a disk-shaped substrate (a disk substrate) to which the exemplary embodiments are applied.

In respective manufacturing processes, first, in a first lapping process shown in FIG. 1A, raw materials of disk-shaped substrates (workpieces) 10 are put on a fixed base 21, and flat surfaces 11 of the disk-shaped substrates 10 are ground. At this moment, on the surface of the fixed base 21 on which the disk-shaped substrates 10 are put, for example, abrasives of diamond are dispersed and spread.

Figure 1B:
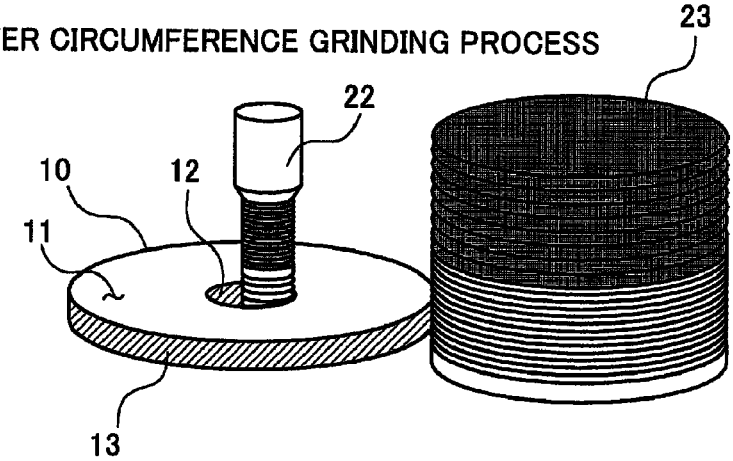

Next, in an inner and outer circumference grinding process shown in FIG. 1B, an inner circumference 12 of a portion having a hole formed at the center of the disk-shaped substrate 10 is ground by an inner circumference grind stone 22, and the outer circumference 13 of the disk-shaped substrate 10 is ground by an outer circumference grind stone 23. More specifically, while a coolant liquid that is composed of, for example, an alkaline solution is supplied to the ground portion, the surface of the inner circumference 12 (an inner circumferential face) and the surface of the outer circumference 13 (an outer circumferential face) of the disk-shaped substrate 10 are held in the radial direction of the disk-shaped substrate 10 and processed at the same time by the inner circumference grind stone 22 and the outer circumference grind stone 23. By grinding the inner circumference 12 and the outer circumference 13 at the same time, coaxial degrees (concentricities) of the internal diameter and the external diameter are easily secured.

Figure 1C:
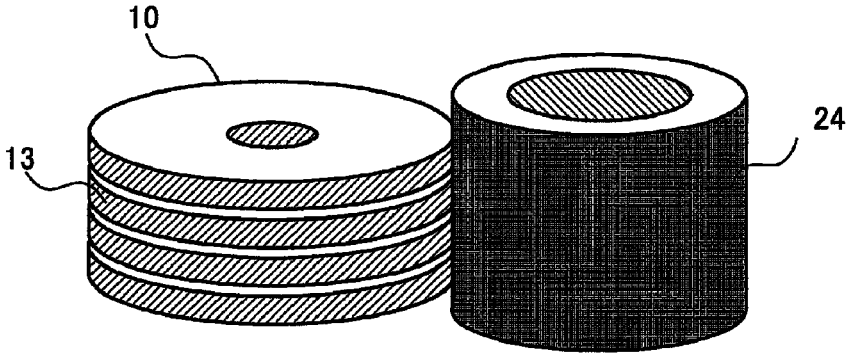

Thereafter, in the outer circumference polishing process shown in FIG. 1C, the outer circumferences 13 of the disk-shaped substrates 10 are polished with an outer circumference polishing brush 24 while a slurry (polishing liquid) is supplied. Although not shown in the figure, in this outer circumference polishing process, the polishing operation is carried out by, for example, respectively attaching two sets of piled workpieces, which are composed of the disk-shaped substrates 10 being piled, to two attachment portions in a working area for the polishing, and then by moving two outer circumference polishing brushes 24 such that the brushes come in contact with the two sets of the piled workpieces. In addition, plural polishing processes are carried out in this polishing operation by using, for example, two types of the outer circumference polishing brushes 24 including an abrasive-grain inclusion brush which is made of nylon (registered trademark) resin including aluminum oxide (alumina) abrasive grains and a regular nylon resin brush without abrasive grains.

Figure 1D:
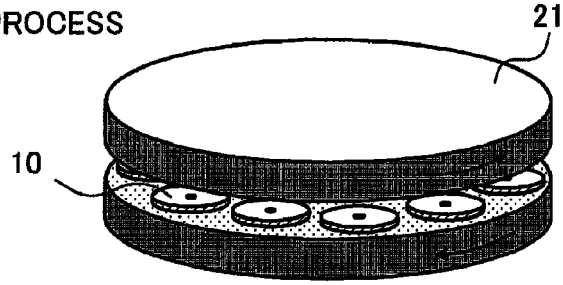

Thereafter, in a second lapping process shown in FIG. 1D, the disk-shaped substrates 10 are mounted on the fixed base 21, and the flat surfaces 11 of the disk-shaped substrates 10 are further ground.

Figure 1E:
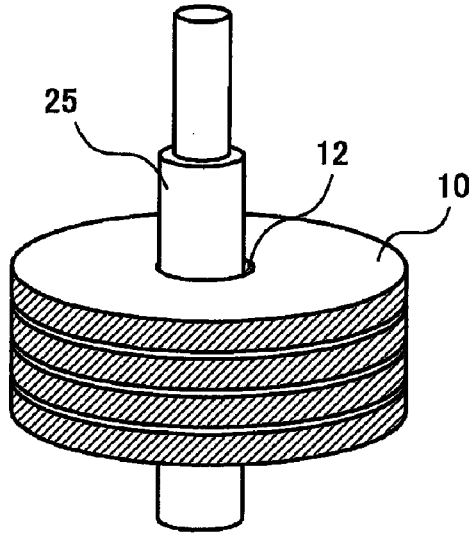

Next, in an inner circumference polishing process shown in FIG. 1E, a brush 25 is inserted into the portions having the hole at the center of the disk-shaped substrates 10, and the inner circumference 12 of the disk-shaped substrates 10 are polished.

Figure 1F:
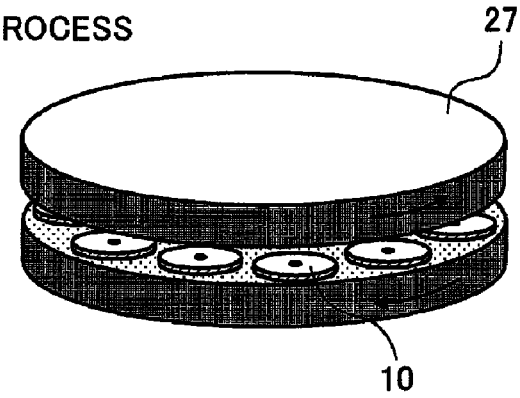

Then, in a first polishing process shown in FIG. 1F, the disk-shaped substrates 10 are mounted on the fixed base 27, and the flat surfaces 11 of the disk-shaped substrates 10 are polished. In the polishing at this moment, for example, hard polisher is used as non-woven cloth (polishing cloth).

Figure 1G:
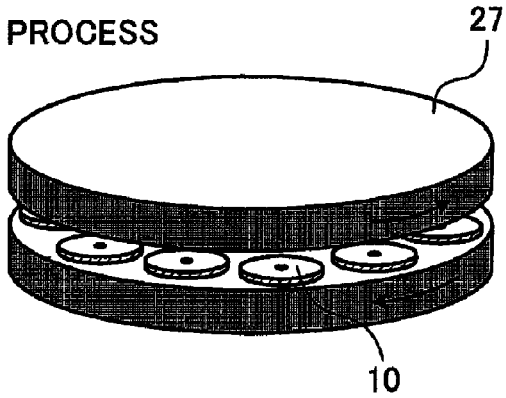

Subsequently, in a second polishing process shown in FIG. 1G, surface polishing with soft polisher is performed.

Figure 1H:
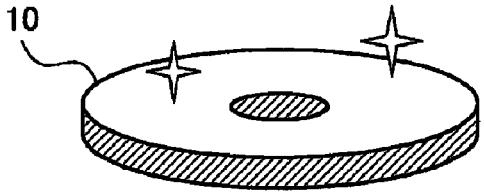

Thereafter, in a final washing and inspection process shown in FIG. 1H, washing and inspection are carried out, and thereby the disk-shaped substrates (disk substrates) 10 are manufactured.

Figure 2:
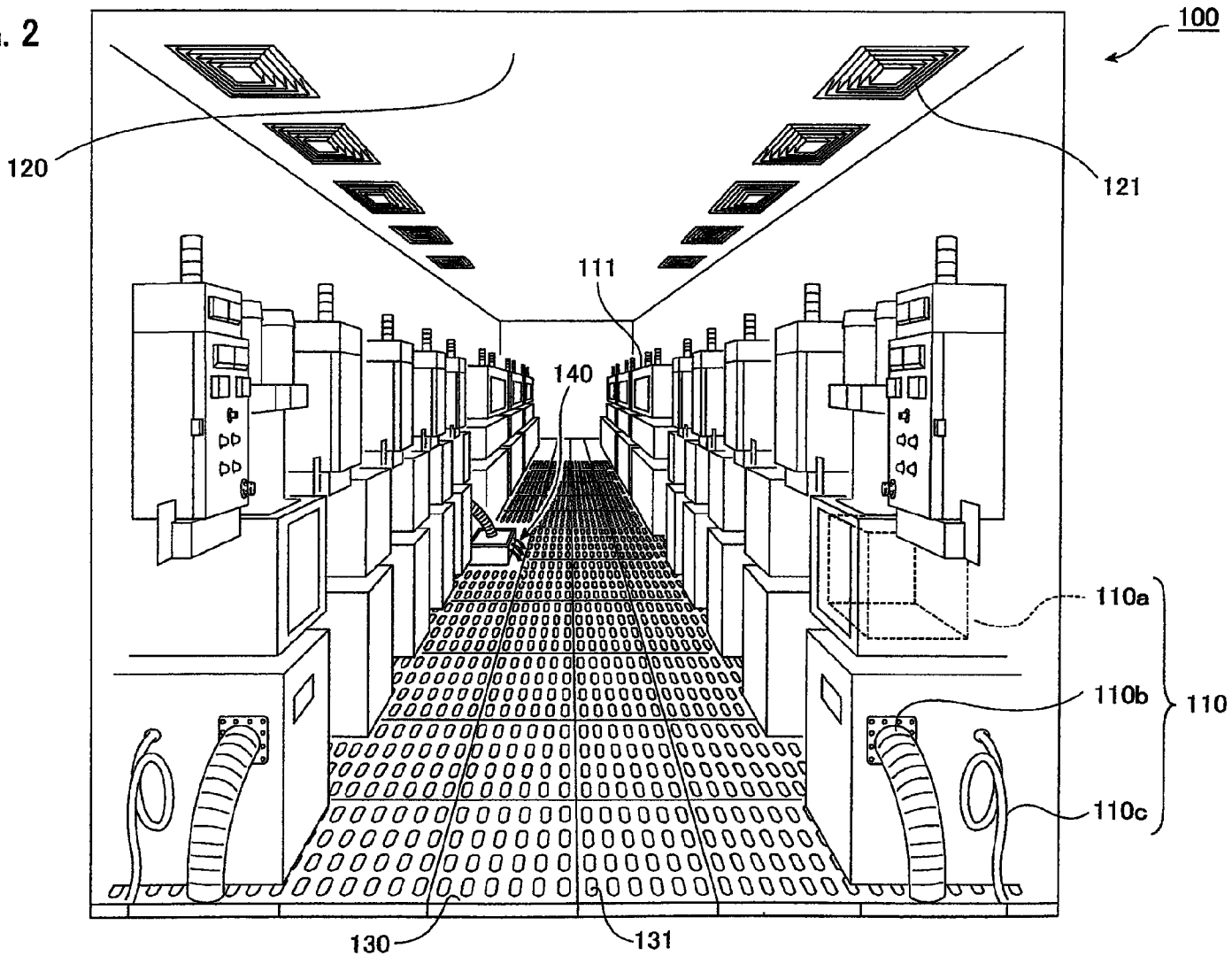
FIG. 2 illustrates a dust removal environment to which the present exemplary embodiment is applied.
Figure 3A:
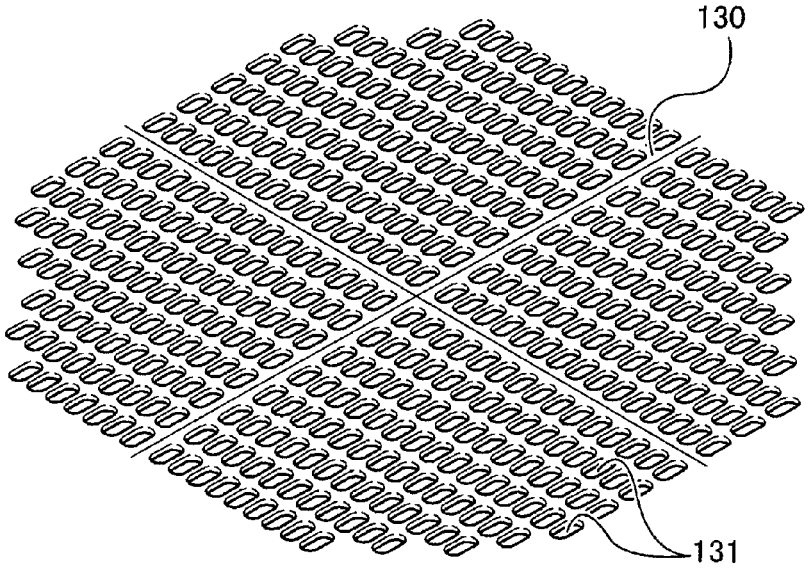
FIGS. 3A and 3B illustrate a perforated floor (upper floor face) and a water-resistant floor (lower floor face) in the dust removal environment.
Figure 3B:
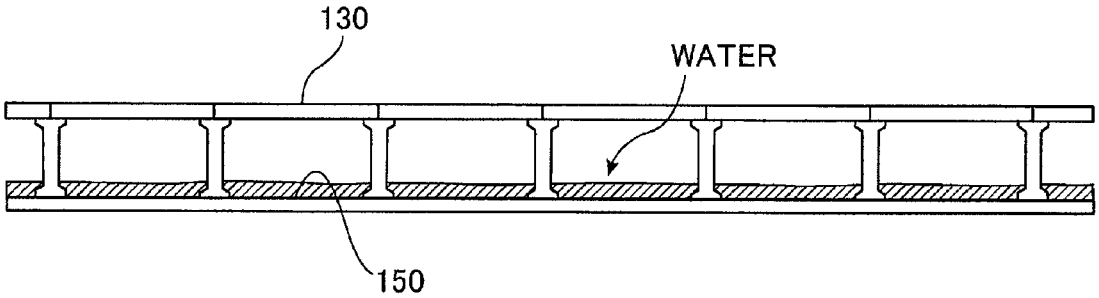

FIGS. 2, 3A and 3B are diagrams for explaining the disk-shaped substrate manufacturing method in a dust removal environment to which the present exemplary embodiment is applied. FIG. 2 illustrates a dust removal environment 100 to which the present exemplary embodiment is applied, while FIGS. 3A and 3B illustrate a perforated floor (upper floor face) 130 and a water-resistant floor (lower floor face) 150 in the dust removal environment 100. In the dust removal environment 100 shown in FIG. 2, for example, a grinding apparatus 110, which is used in the inner and outer circumference grinding process shown in FIG. 1B, and a polishing apparatus 111, which is used in the outer circumference polishing process shown in FIG. 1C, are arranged.

In the upper area of the dust removal environment 100, a ceiling 120 that is subjected to dust preventing measures is formed, and the ceiling 120 is provided with plural blower openings 121 which generate an air stream from the upper area to the lower area. The air-conditioning ducts, wirings and the like for blowing air are arranged on the upper side of the ceiling 120 to be exposed from the surface of the ceiling 120 only at a minimal level. As for the board material of the ceiling 120, the shape and material are selected so that the smoothness is enhanced, fewer gaps are formed, and attachment and generation of dust are minimized. It is preferable to employ wall materials superior in smoothness, corrosion resistance, low dusting characteristics and low charge property, which are, for example, used in clean rooms and the like. Furthermore, the connecting portions of the wall materials of the ceiling 120 are each sealed up with a thin sealing member so that gaps are eliminated as much as possible. Air streams which are generated by the blower openings 121 flow toward the grinding apparatuses 110 and the polishing apparatuses 111 from thereabove; thus, the air is evenly blown to plural grinding apparatuses 110 and polishing apparatuses 111. Air is also blown from the blower openings 121 evenly on the working area (the center part in FIG. 2) where workers handle the polishing apparatuses, in order to clean up this area.

The perforated floor 130 on which the grinding apparatuses 110 and the polishing apparatuses 111 are provided has a configuration illustrated in FIG. 3A, for example. A lath board (mesh board) which is provided with a series of penetration holes 131 is employed as the perforated floor 130. For example, a stainless steel board in which penetration holes 131 are regularly formed or a metal lath board which is made of slender boards connected with wires may also be employed. Such a metal lath board may also be made of, for example, a thick wire material woven to form a board having a certain thickness. Furthermore, flat boards may be arranged with gaps therebetween in lath form to serve as the perforated floor 130. In the case where a lath board is made of a metal board which is provided with a series of penetration holes 131, the floor is more stable than in the case where a board is made of a woven wire material; thus, the workability of workers may be improved.

Furthermore, as illustrated in FIG. 3B, the whole bottom part of the perforated floor 130 is raised, and a water-resistant floor 150, which holds water and form a water current, is formed below the perforated floor 130. In other words, the water-resistant floor 150 supports the perforated floor 130 thereabove with a distance provided therebetween. As shown in FIG. 2, a feed-water tank 140 is placed in a predetermined position on the perforated floor 130. Water is continuously supplied from the feed-water tank 140 to the water-resistant floor 150. It is effective to arrange the feed-water tank 140 not in one position but in plural positions. The water fed from the feed-water tank 140 flows to fill the water-resistant floor 150 as shown in FIG. 3B, forms a current, and then is discharged as sewer water. To be more specific, dust in the air carried by air blown from the blower openings 121 on the ceiling 120 shown in FIG. 2 and dust from the grinding apparatuses 110 and the polishing apparatuses 111 go through the penetration holes 131 in the perforated floor 130, are caught in the water filling the water-resistant floor 150, and are washed away with the water. In this system, dust in the air and dust from the grinding apparatuses 110 and the polishing apparatuses 111 are removed from the room; thus, the amount of dust in the room may be largely reduced. It should be noted that the water used in this system may be circulated and recycled by, for example, removing a target particle by using a certain filter and the like.

Furthermore, FIG. 2 illustrates, in the grinding apparatus 110, a processing area 110*a*, a piping 110*b* which is used for, for example, feeding and discharging of the polishing liquid, and a wiring 110*c* which drives the grinding apparatus 110. In the present exemplary embodiment, the piping 110*b* and the wiring 110*c* are provided in an area below the processing area 110*a* in the grinding apparatus 110. A part projecting from the chassis of the grinding apparatus 110 tends to collect dust. If such accumulated dust falls, the dust attaches to the disk-shaped substrate 10. Therefore, a risk of accumulated dust falling and coming in contact with a workpiece in process may be reduced by providing the piping 110*b* and the wiring 110*c*, which are projecting from the chassis of the grinding apparatus 110, in an area below the processing area 110*a* in the grinding apparatus 110. It should be noted that, although not shown in FIG. 2, a piping and a wiring, which are not shown in the figure, in the polishing apparatus 111 are also provided in an area below the processing area, which is not shown in the figure.

An example where the present exemplary embodiment is adopted is shown below.

Disk type: 1.89 inches

Diameter of the outer circumference 13 (external diameter): 48 mm

Diameter of the inner circumference 12 (internal diameter): 12 mm

Thickness: 0.55 mm

For example, in the inner and outer circumference grinding process shown in FIG. 1B, following conditions are used:

Inner circumference grind stone 22:

Diameter of approximately 9 mm

Rotation number of 10,000 to 12,000 rpm

Outer circumference grind stone 23:

Diameter of approximately 160 mm

Rotation number of 3,500 to 4,000 rpm

Rotation number of the disk-shaped substrate (workpiece) 10: approximately 14 rpm In this case, rough grinding is carried out using the rough grinding surfaces of the inner circumference grind stone 22 and the outer circumference grind stone 23 by moving the inner circumference grind stone 22 and the outer circumference grind stone 23 from the grinding start position by, for example, 0.9 mm in the direction of coming closer to each other while a coolant liquid is supplied. The coolant liquid is used for cooling, preventing rust on the apparatus, and promoting a dressing action (an action for grinding off the pad surface of a diamond grinding stone to expose a fresh surface of the pad). Thereafter, while supplying the coolant liquid, finishing grinding is carried out with the finishing grinding surfaces of the inner circumference grind stone 22 and the outer circumference grind stone 23 by moving the inner circumference grind stone 22 and the outer circumference grind stone 23 by, for example, 0.1 mm from the position where the rough grinding is completed. At the end of each rough grinding and finishing grinding, while the stopping position is maintained, the inner circumference grind stone 22, the outer circumference grind stone 23 and the disk-shaped substrate 10 are rotated for a predetermined period of time (for example, approximately 12 to 18 seconds) so as to perform so-called spark-out. By performing this spark-out, the circumference surface of the inner circumference 12 and the outer circumference 13 are made smooth.

In the outer circumference polishing process shown in FIG. 1C, processing is carried out under the following conditions:

Piled Workpieces

The piled number of the disk-shaped substrates 10: 150 pieces

A spacer is interposed between each disk-shaped substrate.

Diameter of the spacer: 46 mm, thickness thereof: 0.2 mm

The Abrasive-Grain Inclusion Brush

External diameter: 150 mm

Resin: Nylon (registered trademark) (For example, Nylon-6)

Wire diameter: 0.3 mm

Abrasive grains: Aluminum oxide (alumina) having a diameter of 30 μm and a grade of #600

Content rate: 20%

The Resin Brush 60

External diameter: 150 mm

Material: Nylon-66

Wire diameter: 0.2 mm

Slurry (Polishing Liquid)

Specific gravity: 1.2

Processing Time

Polishing process with the abrasive-grain inclusion brush: 23 minutes (a first predetermined time) is repeated four (4) times Polishing process with the resin brush: 12 minutes (a second predetermined time) is repeated four times In this processing, while supplying the slurry, a total of four polishing processes, including two processes upon inverting the top and the bottom of the two sets of piled workpieces between the processes, and two processes upon switching the attachment positions of the two sets of piled workpieces between the processes, are carried out for each of the cases where the abrasive-grain inclusion brush is used and the resin brush is used. In these processes, the two sets of piled workpieces and the two outer circumference polishing brushes 24 are reciprocated in the direction of the axis thereof; thus, the piled workpieces are polished with different parts of the outer circumference polishing brushes 24. By inverting the piled workpieces in the axis direction, the rotation direction of the outer circumference polishing brushes 24 in respect to the disk-shaped substrates 10 piled in the piled workpieces is changed. Furthermore, by switching the positions of the piled workpieces in respect to the attachment portions, variation resulting from the polishing due to the contact position with the outer circumference polishing brushes 24 is reduced; thus, the polishing condition may be made more uniform.

In the present exemplary embodiment, particles such as glass chips, metal pieces, fiber pieces and silica-based dust are generated in the above-mentioned inner and outer circumference grinding process and the outer circumference polishing process. Some particles are washed off with the coolant liquid and the slurry (polishing liquid) that are used for the grinding or the polishing, while a large amount of particles remain floating in the air. Having the surface being activated, the disk-shaped substrate 10 to be ground and polished tends to attract particles. Therefore, if no measure is taken, the particles floating in the air easily attach to the surface of the disk-shaped substrate 10. Moreover, in the case where particles come to be mixed in the coolant liquid and the slurry before use, the substrate may be damaged in the grinding and the polishing.

However, according to the present exemplary embodiment, particles in the air carried by an air stream which is, for example, blown from the blower openings 121 in the ceiling 120 shown in FIG. 2, go through the penetration holes 131 in the perforated floor 130, are caught in the water filling the water-resistant floor 150, and are washed away with the water. In this system, the amount of particles in the air may be reduced by a simple configuration; thus, a high-precision disk-shaped substrate 10 may be produced while keeping manufacturing cost low.

It should be noted that, although the present exemplary embodiment is described by referring to the example of the dust removal environment 100 in the inner and outer circumference polishing process shown in FIG. 1B and the outer circumference polishing process shown in FIG. 1C, the dust removal environment 100 may also be adopted in other processes. It is desired to use a clean room which provides higher dust removal capability in, for example, the polishing process and the final washing process. In the meantime, in the preceding processes in which relatively lower dust removal capability is acceptable, it is preferable to adopt the present exemplary embodiment which may be achieved with a simple facility.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A disk-shaped substrate manufacturing method, where a disk-shaped substrate is ground under a dust removal environment that is not a clean room as a previous step of a process performed in a clean room, comprising:

grinding a disk-shaped substrate in a grinding apparatus that contains piping or wiring of the grinding apparatus on which dust accumulates on the piping or wiring and falls therefrom;

generating an air stream downward from an upper area with respect to the grinding apparatus placed in the dust removal environment during grinding the disk-shaped substrate in the grinding apparatus;

performing the grinding in a grinding apparatus that is arranged on an upper floor face of a floor while water is present on a lower floor face of the floor, the upper floor face being made of a board having penetration holes or a mesh member, and the lower floor face supporting the upper floor face so as to be located above the lower floor face with a distance;

guiding dust made by the grinding apparatus to the water by use of the air stream; and reducing contact of dust accumulated on the piping or the wiring and falling therefrom to the disk-shaped substrate in processing by grinding the disk-shaped substrate in a grinding apparatus that contains the piping or wiring of the grinding apparatus below a processing area of the grinding apparatus.

2. The disk-shaped substrate manufacturing method according to claim 1, wherein the upper floor face is a lath board made of a metal board having a series of penetration holes.

3. The disk-shaped substrate manufacturing method according to claim 1, wherein the water on the lower floor face forms a flow below the upper floor face.

4. The disk-shaped substrate manufacturing method according to claim 1, wherein the upper floor face also spreads in a working area for an operator handling the grinding apparatus, and an air steam is generated in the working area so as to guide dust to the water, while the grinding apparatus is exposed to the air stream.

5. A disk-shaped substrate manufacturing method, where a disk-shaped substrate is polished under a dust removal environment that is not a clean room as a previous step of a process performed in a clean room, comprising:

polishing a disk-shaped substrate in a polishing apparatus that contains piping or wiring of the polishing apparatus on which dust accumulates on the piping or wiring and falls therefrom;

generating an air stream downward from an upper area with respect to a polishing apparatus placed in the dust removal environment during polishing a disk-shaped substrate in the polishing apparatus during polishing a disk-shaped substrate in the polishing apparatus;

performing the polishing in a polishing apparatus that is arranged on an upper floor face of a floor while water is present on a lower floor face of the floor, the upper floor face being made of a board having penetration holes or a mesh member, and the lower floor face supporting the upper floor face so as to be located above the lower floor face with a distance;

guiding dust made by the polishing apparatus to the water by use of the air stream; and reducing contact of dust accumulated on the piping or the wiring and falling therefrom to the disk-shaped substrate in processing by polishing the disk-shaped substrate in a polishing apparatus that contains the piping or wiring of the polishing apparatus below a processing area of the polishing apparatus.

6. The disk-shaped substrate manufacturing method according to claim 5, wherein the upper floor face is a lath board made of a metal board having a series of penetration holes.

7. The disk-shaped substrate manufacturing method according to claim 5, wherein the water on the lower floor face forms a flow below the upper floor face.

8. The disk-shaped substrate manufacturing method according to claim 5, wherein the upper floor face also spreads in a working area for an operator handling the polishing apparatus, and an air steam is generated in the working area so as to guide dust to the water, while the polishing apparatus is exposed to the air stream.

* * * * *